United States Patent [19]

Cranford

[11] Patent Number: 5,076,499

[45] Date of Patent: Dec. 31, 1991

[54] FUEL INJECTOR VALVE HAVING A SPHERE FOR THE VALVE ELEMENT

[75] Inventor: Stephen Cranford, Newport News, Va.

[73] Assignee: Siemens Automotive L.P., Auburn Hills, Mich.

[21] Appl. No.: 604,693

[22] Filed: Oct. 26, 1990

[51] Int. Cl.[5] ..... B05B 1/30

[52] U.S. Cl. ..... 239/585; 251/129.14

[58] Field of Search ..... 239/585; 251/129.14, 251/129.17, 129.19

[56] References Cited

U.S. PATENT DOCUMENTS

| | | | |
|---|---|---|---|
| 2,828,936 | 4/1958 | Haleo | 251/129.14 X |
| 4,394,962 | 7/1983 | Wilber | 239/585 X |
| 4,684,104 | 8/1987 | Micard | 239/585 X |
| 4,922,482 | 2/1988 | Jordan et al. | 239/585 |
| 4,997,133 | 3/1991 | Ausiello et al. | 239/585 |

FOREIGN PATENT DOCUMENTS

| | | | |
|---|---|---|---|
| 59-567 | 1/1984 | Japan | 239/585 |
| 1330181 | 9/1973 | United Kingdom | 239/585 |

*Primary Examiner*—Andres Kashnikow
*Assistant Examiner*—Kevin P. Weldon
*Attorney, Agent, or Firm*—George L. Boller; Russel C. Wells

[57] ABSTRACT

The sphere is a separate part that is assembled into the valve during the assembly process. A resilient spring disc acts on the sphere to hold the sphere in abutment with the tip end of the armature as the armature reciprocates to open and close the valve. The disc is also a separate part that is assembled into the valve during the assembly process. The outer margin of the disc rests on a raised ledge without attachment to the valve body while the sphere occupies a central circular void in the disc whose diameter is less than that of the sphere. The valve seat is frustoconical, and the disc maintains the sphere at least approximately concentric with the seat so that when the valve is operated closed any misalignment of the sphere to the seat is taken out by the camming action of the seat on the sphere as the valve closes.

19 Claims, 5 Drawing Sheets

FUEL INJECTOR VALVE HAVING A SPHERE FOR THE VALVE ELEMENT

FIELD OF THE INVENTION

This invention relates to electrically operated fuel injectors of the type commonly used to inject fuel into spark-ignited internal combustion engines.

BACKGROUND AND SUMMARY OF THE INVENTION

In fuel injectors the valving mechanism typically comprises a reciprocal valve element that seats on and unseats from a valve seat. Sealing of the valve element to the valve seat, when the fuel injector is closed, is important in avoiding fuel leakage, or drip. Since the sealing is attained by only metal-to-metal contact, the shapes of the valve element and the seat are especially important. A valve element which has a spherical contoured surface for seating on a frusto-conical valve seat has been found to provide effective sealing. Various designs have been proposed for embodying a spherically contoured surface in a fuel injector valve element.

In one known design, the distal end of a cylindrical needle is shaped to have essentially a semi-spherical surface. In another known design, a truncated sphere (slightly larger than a semi-sphere for example) is the valve element. In still another known design, an entire sphere is joined to one end of a tube. The use of any of these designs affects the fuel injector cost because they require joining and/or metalworking operations in order to make the valve element.

The use of a simple sphere is advantageous because such spheres can be economically fabricated with precision in large volumes. Because of the cost disadvantages which are inherent in the known designs just described, it would be beneficial if a fuel injector could incorporate a sphere without the injector fabrication process requiring joining and/or metalworking of the sphere. In other words, it would be advantageous if the sphere is nothing more than a part which is merely assembled into a fuel injector during the assembly process.

Another factor that contributes to the cost of known fuel injector designs, such as those in which the spherical contoured surface is at one end of an elongated member, is the necessity of securing precise alignment of the valve member to the seat. Precision metalworking operations must be conducted on several individual parts, and assembly of the parts must be carefully performed. Even with the use of sophisticated manufacturing techniques, today's mass-production of fuel injectors still results in a significant percentage which are unable to meet engineering performance specifications when tested after assembly. These injectors must be then re-worked, resulting in added cost.

A still further consideration in fuel injector design is the desire to miniaturize fuel injectors for certain uses. Fuel injectors which are presently in commercial production are not large parts, but the market is seeking injectors which are even smaller. Such miniaturized fuel injectors will require smaller individual parts, and because such parts are more difficult to process, manufacturing complexity is likely to be amplified. This is a further reason why the use of a simple sphere as the valve element would be desirable.

The present invention relates to a new and improved electrically-operated fuel injector which utilizes a simple sphere as the valve element. The process for fabricating the fuel injector does not require the use of joining or metalworking operations on the sphere: the sphere is simply one of the individual parts of the fuel injector. The organization and arrangement of the fuel injector provides for the inherent self-alignment of the sphere to the valve seat while avoiding the precision finishing operations required to secure the accurate alignment of the valve element with the valve seat in known fabrication procedures. The organization and arrangement is also adapted to render the fuel injector well-suited for miniaturization.

As a consequence, the invention provides a fuel injector which is electrically operated, and which can be miniaturized, but without incurring prohibitively expensive manufacturing costs. Further features, advantages, and benefits of the invention will be seen in the ensuing description and claims which are accompanied by drawings. The drawings disclose a presently preferred embodiment of the invention according to the best mode contemplated at the present time in carrying out the invention.

DESCRIPTION OF THE PREFERRED EMBODIMENT

Figure 1:
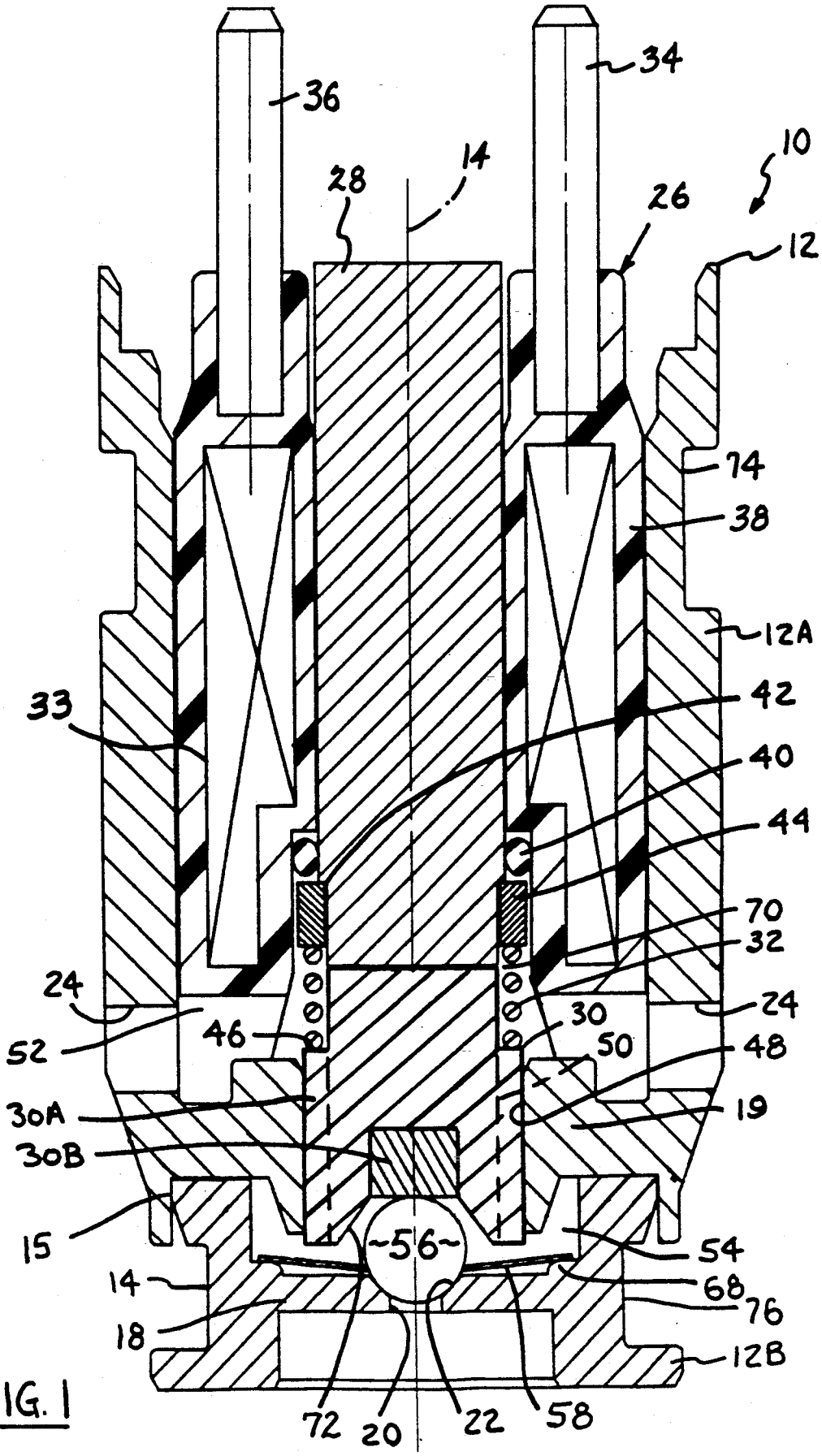
FIG. 1 is a longitudinal cross sectional view through a first embodiment of fuel injector embodying principles of the present invention.

The first embodiment of electrically operated fuel injector valve 10 comprises a valve body 12 having a main longitudinal axis 14. Valve body 12 is composed of two separate parts 12A, 12B which are joined together at a joint 15. Valve body 12 comprises a cylindrical side wall 16 which is generally coaxial with axis 14 and an end wall 18 that is disposed at one longitudinal end of side wall 16 generally transverse to axis 14. Part 12B contains end wall 18 and a portion of side wall 16. Part 12A contains the remainder of side wall 16, and it also comprises a transverse wall 19 which is spaced interiorly of end wall 18.

A circular through-hole 20 is provided in end wall 18 substantially coaxial with axis 14 to provide a fuel outlet from the interior of the valve body. Through-hole 20 has a frusto-conical valve seat 22 at the axial end thereof which is at the interior of the valve body. A thin disc orifice member (not shown) is typically disposed over the open exterior end of through-hole 20 so that the fuel that passes through through-hole 20 is emitted from the injector valve via one or more orifices in the thin disc orifice member.

The fuel injector valve has a fuel inlet in the form of plural radial holes 24 extending through side wall 16, and it also contains an internal fuel passage, to be hereinafter described in more detail, from the fuel inlet to the fuel outlet. Holes 24 are located immediately adjacent transverse interior wall 19, adjacent to the face thereof that is opposite the face against which part 12B is disposed. This configuration portrays what is commonly called a side- or bottom-feed type fuel injector.

Valve 10 further comprises an electrical actuator mechanism which includes a solenoid coil assembly 26, a stator 28, an armature 30, and a bias spring 32. Solenoid 26 comprises an electromagnetic coil 33 whose terminations are joined to respective electrical terminals 34, 36 which project longitudinally away from the valve at the end thereof which is opposite end wall 18. The terminals 34, 36 are configured for mating connection with respective terminals of an electrical connector plug (not shown) which is connected to the fuel injector valve when the valve is in use. The entirety of coil 33, including the attachment of its terminations to terminals 34, 36, is encapsulated in a suitable encapsulant 38 which gives the solenoid assembly a generally tubular shape.

Stator 28 has a general cylindrical shape which provides for it to be fitted within solenoid assembly 26 in the manner shown in FIG. 1 to concentrate the magnetic flux that is generated by coil 33 when the coil is electrically energized. The side wall of stator 28 is hydraulically sealed with respect to the inner side wall of solenoid assembly 26 by means of an elastomeric O-ring seal 40. Seal 40 prevents fuel that has been introduced into the interior of the valve via holes 24 from leaking out of the valve via any potential leak paths that may exist between the external cylindrical surface of the stator and the internal cylindrical surface of the solenoid assembly.

Stator 28 comprises a shoulder 42 on the fuel side of O-ring seal 40 and facing end wall 18. A bearing ring 44 having a rectangular cross-section as seen in FIG. 1 is disposed over the end of stator 28 that is toward end wall 18, and it bears against shoulder 42. Armature 30 has a shoulder 46 which faces ring 44. Spring 32 is disposed between ring 44 and shoulder 46 for the purpose of resiliently urging the armature longitudinally toward end wall 18.

Transverse interior wall 19 comprises a circular through-hole 48 that is coaxial with axis 14 and provides a guide for armature 30. That portion of the armature which is between shoulder 46 and the end of the armature that is toward end wall 18 has a circular cylindrical side wall surface dimensioned for a close sliding fit in through-hole 48. This cylindrical side wall surface of armature 30 is not circumferentially continuous, but rather is interrupted by axially extending slots 50 distributed circumferentially around the armature. These slots 50 form a portion of the internal fuel passage between the fuel inlet and the fuel outlet by establishing communication between a zone that lies at one longitudinal end of transverse wall 19 and a zone that lies at the opposite longitudinal end of wall 19. One of these two zones is an annular interior space 52 that lies interiorly of holes 24 and surrounds armature 30; the other is an interior space 54 that is circumferentially bounded by that portion of side wall 16 formed by part 12B and that is longitudinally bounded by wall 18 at one longitudinal end and by wall 19 and armature 30 at the opposite longitudinal end. It is within space 54 that the valve element of the fuel injector is disposed.

The valve element is a sphere 56 that in FIG. 1 is shown coaxial with axis 14 and seated on valve seat 22 to close through-hole 20. This represents the closed condition of fuel injector valve 10. In this condition the solenoid assembly is not electrically energized and so the resilient bias of spring 32 acting through armature 30 causes sphere 56 to be forcefully held on seat 22.

Sphere 56 is an entirely separate part that is not joined to any other part of the valve. In other words, in the absence of any action by armature 30 or by other parts of the operative mechanism of the valve, sphere is free to assume any position within space 54. In accordance with certain principles of the invention, sphere 56 is constrained in a particular way so that it will follow the longitudinal motion of armature 30 when the latter is operated by the solenoid assembly, but in such a way that the sphere will always be self-centering on seat 22 when the valve is operated closed.

Figure 2:
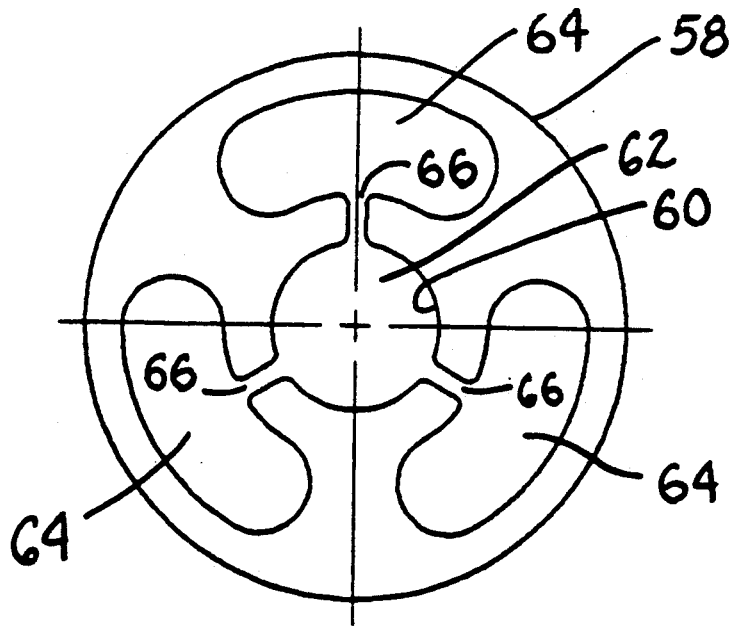
FIG. 2 is a plan view of one of the several parts of the fuel injector shown by itself.

The remainder of the mechanism which cooperates with armature 30 in controlling sphere 56 is a resilient spring disc 58 which is disposed in space 54 for coaction with sphere 56. The shape of disc 58, which is representative of one of a number of possible designs, can be best seen in FIG. 2. The disc contains a central through-aperture 60 which defines a circular void 62 of a diameter less than the diameter of sphere 56. It also defines three kidney-shaped voids 64 which are arranged 120° apart and each of which is joined with void 62 by a corresponding radial slot 66. The radially outer circumferentially extending margin of the disc is circumferentially continuous.

Disc 58 and sphere 56 are disposed in valve 10 such that sphere 56 fills the entirety of void 62. End wall 18 contains a raised annular ledge 68 surrounding seat 22 coaxial with axis 14. The circumferentially continuous outer peripheral margin of disc 58 rests on ledge 68. The diameter of the disc is less than the diameter of space 54 so that the disc is capable of a certain limited amount of radial displacement within space 54.

In the closed condition shown in FIG. 1, the resilient bias force exerted by spring 32 on sphere 56 has, in addition to forcing the sphere to close through-hole 20, also flexed spring disc 58 so that the spring disc is exerting a certain force on the sphere in the opposite direction from the force exerted by spring 32. In this closed condition, there is a small gap 70 between confronting end faces of stator 28 and armature 30.

The energization of solenoid assembly 26 will exert an overpowering force on armature 30 to close gap 70 thereby further compressing spring 32 in the process. The resulting motion of the armature away from sphere 56 means that the dominant force applied to the sphere during this time is that which is exerted by disc 58 in the direction urging the sphere toward the armature. Disc 58 is designed through use of conventional engineering design calculations to cause sphere 56 to essentially follow the motion of the armature toward stator 28. The result is that the sphere unseats from seat 22 to allow the pressurized liquid fuel that is present within the interior of the fuel injector to pass through through-hole 20. So long as sphere 56 remains unseated from seat 22, fuel can flow from holes 24 through space 52, through channels 50, through space 54 predominantly via voids 64, to the fuel outlet at through-hole 20.

When solenoid assembly 26 is de-energized, the magnetic attraction force on armature 30 dissipates to allow spring 32 to once again force armature 30 toward sphere 56 and cause the sphere to close through-hole 20 by seating on seat 22. It is to be observed that the amount of longitudinal travel of the armature is quite small so that a portion of the sphere will always be disposed in seat 22 even though the sphere itself may not be closing through-hole 20 to fuel flow. If for any reason sphere 56 were to become eccentric with respect to seat 22, the reaction of the sphere with the valve seat in response to armature motion tending to close the valve will create a self-centering tendency toward correcting the eccentricity. This self-centering tendency is allowed to occur because disc 58 is unattached to the valve body. Stated another way, the sphere and disc can "float" radially as a unit so that any eccentricity which may exist between the sphere and the seat is eliminated as the armature operates to force the sphere against the seat toward the final objective of closing the fuel outlet.

While a valve embodying the inventive principles will exhibit the highly advantageous self-centering of the sphere upon closing, a further distinct advantage is that during the process of assembly of the valve, the disc and sphere are merely two separate parts that are assembled into the fuel injector. There is no joining or metalworking operation that is required on either of these two parts after they have been initially fabricated. The sphere is, of course, fabricated by conventional ball fabrication technology, and the resilient spring disc is fabricated by conventional metalworking techniques. Therefore, even if there is some degree of misalignment (i.e. eccentricity) between the sphere and the seat after the valve has been assembled, commencement of operation will immediately cause the sphere to become centered on the seat so that proper closure of through-hole 20 will be attained when the valve is in the closed position.

While the sphere has thus been shown to be axially captured between armature 30 and disc 58, there is also a radial confinement that is provided by the particular shape of the armature tip end. The tip end of the armature is shaped to have a frusto-conical surface 72 that is essentially coaxial with axis 14. When sphere 56 is seated on seat 22, surface 72 is spaced from the sphere. There is thus a limited range of radial displacement (eccentricity relative to axis 14) for the sphere which will be tolerated before surface 72 will actively prevent any further radial displacement of the sphere. It is also to be observed that the armature is in fact a two part construction comprising a main armature body 30A and an insert 30B which provides the contact surface with sphere 56 to axially capture the sphere. The radial confinement provided by surface 72 will keep the sphere at least proximately concentric within the axis within the radial confinement imposed on the sphere by the tip end of the armature, while still allowing the disc and sphere together to be radially displaced relative to the axis such that when the injector operates to closed position any eccentricity of the sphere relative to the valve seat will be removed by the camming effect of the seat on the sphere with the result that the sphere precisely centers itself on the seat to thereby fully closed through-hole 20 while continuously filling void 62.

In use, the injector is typically operated in a pulse width modulated fashion. The pulse width modulation creates axial reciprocation of the sphere so that fuel is injected as separate discrete injections. The exterior of side wall 16 contains axially spaced apart circular grooves 74, 76 which are adapted to receive O-ring seals (not shown) for sealing of the injector body to an injector-receiving socket into which a side-feed type injector is typically disposed. The organization and arrangement of the illustrated injector provides for compactness and for assembly processing by automated assembly equipment. The overall fabrication process can be conducted in a more efficient manner in comparison to prior processes because the inherent self-centering characteristic that is provided by the inventive principles does not require as highly precise finishing and alignment of parts as required in the prior processes described above. Moreover, the sphere and disc are separate parts that are simply assembled into the fuel injector during the assembly process. The dimensional tolerances on certain parts can be greater (thereby making those parts less costly), plus the organization and arrangement is definitely conducive to fuel injector valve miniaturization.

Figure 3:
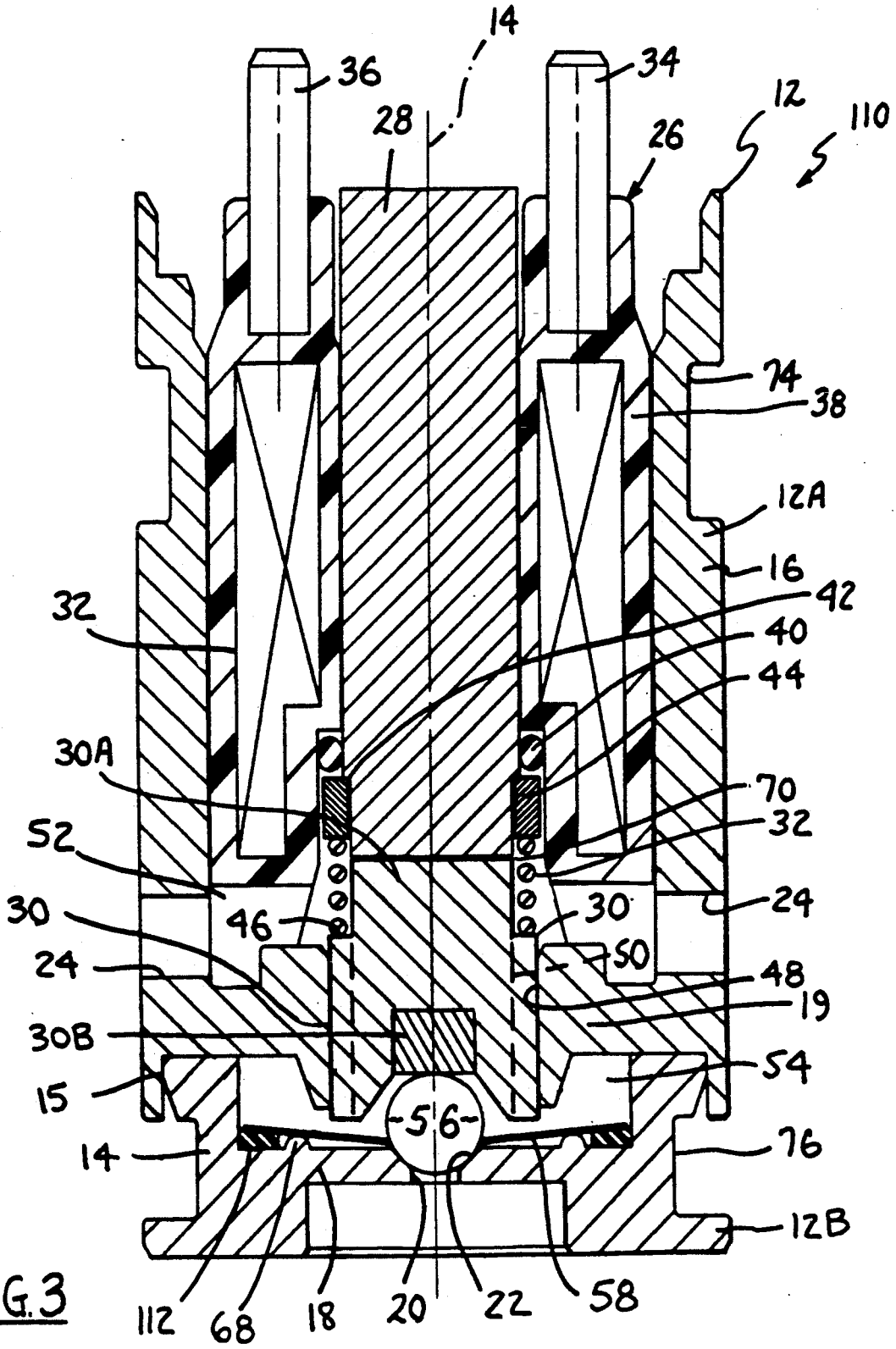
FIG. 3 is a view similar to FIG. 1 showing a second embodiment.

The second embodiment of fuel injector 110 is exactly identical to the first embodiment except for the organization and arrangement of ledge 68 and the inclusion of one additional part 112. In FIG. 3 it can be seen that ledge 68 is spaced radially inwardly from the side wall of space 54 so that disc 58 rests on ledge 68 along a more radially inwardly disposed portion. The outer peripheral margin of the disc is in contact with the additional part 112, which is in the form of a circular annular, soft, spongy member, of suitable material, which is disposed between ledge 68 and the side wall bounding space 54. The member 112 still permits the sphere and the disc to float radially, but with a certain restriction that is not present in the first embodiment.

Figure 4:
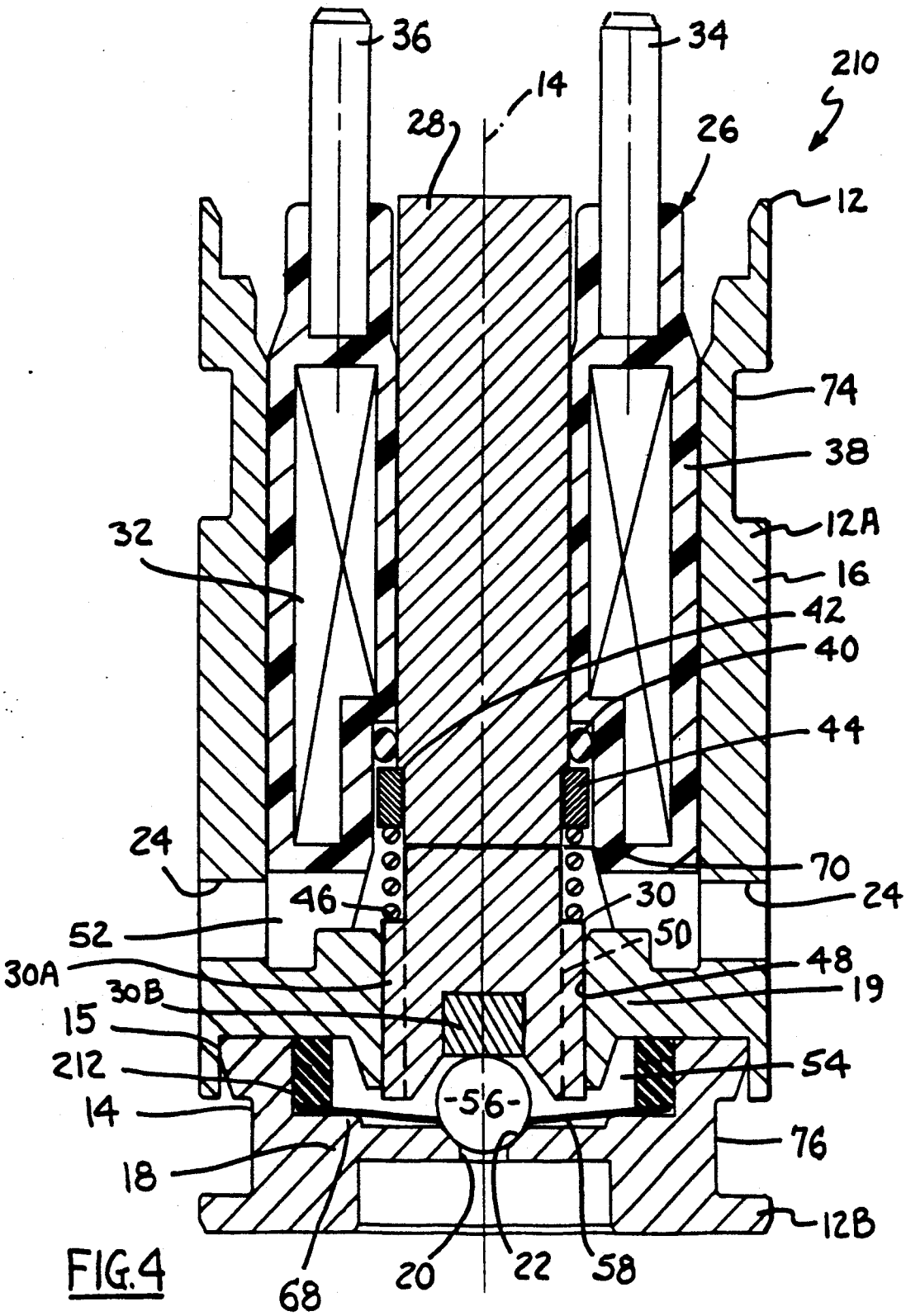
FIG. 4 is a view similar to FIG. 1 showing a third embodiment.

The third embodiment 210 of FIG. 4 is like the first embodiment except that it includes a soft, spongy, annular element 212. Element 212 acts on the opposite face of disc 58 from that of the second embodiment. It performs the same function of permitting the sphere and disc to float radially but with a slight amount of restriction not present in the first embodiment.

Figure 5:
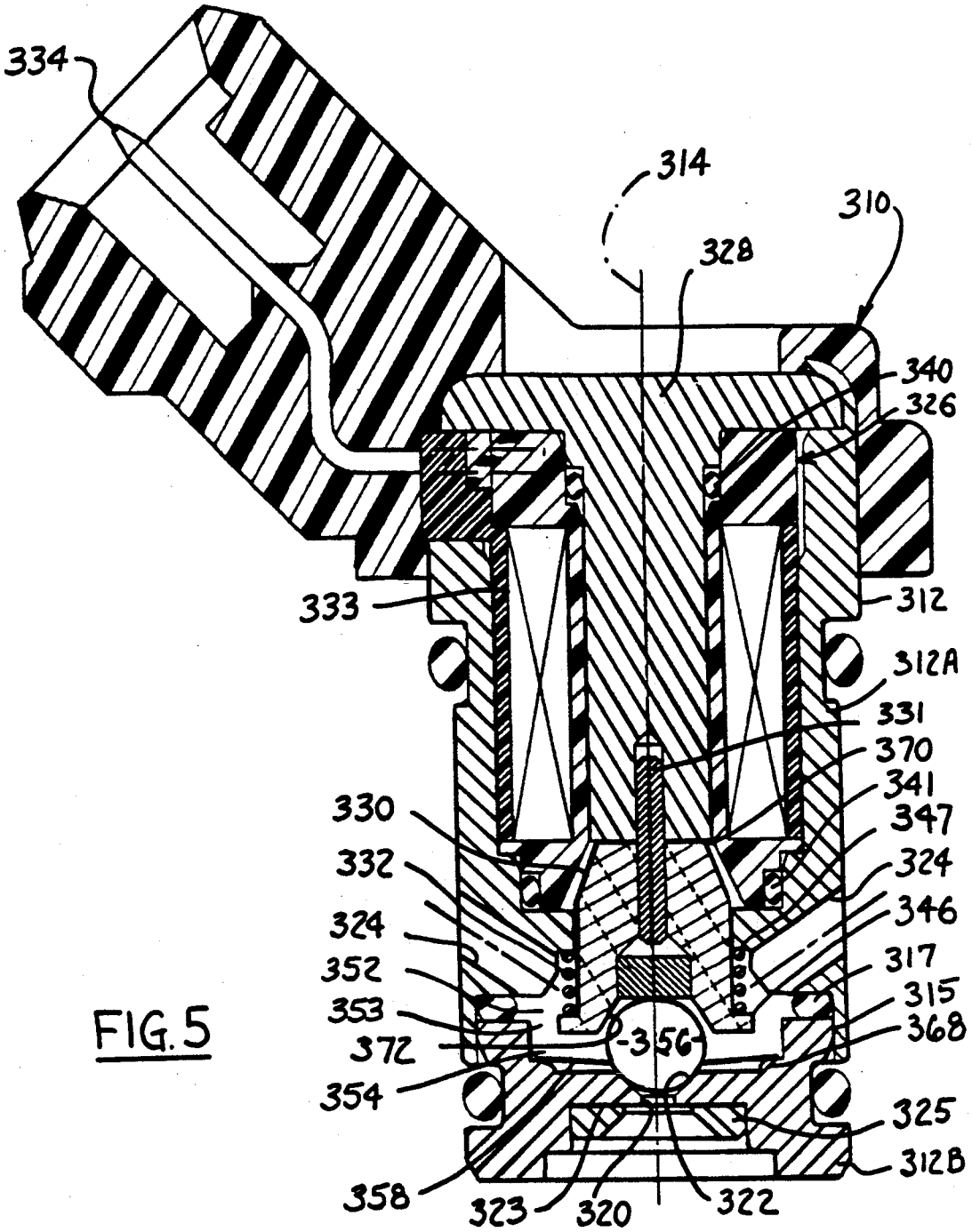
FIG. 5 is a longitudinal cross sectional view of a fourth embodiment.

FIG. 5 presents a fourth embodiment 310 which comprises a solenoid 326 and a valve body 312 which has a main longitudinal axis 314 and is composed of two separate parts 312A, 312B which are joined together at a joint 315 which includes a seal 317. Solenoid 326 has a coil 333 with which a stator 328 is cooperatively arranged. Electrical terminals 334 (only one of which actually appears in FIG. 5) provide for the connection of the solenoid to a control circuit. Part 312B has a circular through-hole 320 with a frusto-conical valve seat 322 at its interior end. The exterior end of the through-hole is covered by a thin disc orifice member 323 and the latter is held in place by an annular retaining ring 325 that is joined with part 312B in any conventional manner. Inlet holes 324 lead to an interior space 352 which is communicated with another interior space 354 by means of radial clearance 353 provided between the lower (as viewed in the drawing) end of an armature 330 and the upper end of part 312B. A sphere 356 and a disc 358 are arranged between armature 330 and part 312B in the same fashion as in injector valve 10, part 312B including a ledge 368 like ledge 68, armature 330 including a surface 372 like surface 72, and disc 358 being identical to disc 58. Armature 330 has a shoulder 346, part 312A has a shoulder 347, and a coil spring 332 is disposed between these two shoulders to bias the sphere to seat on seat 322. O-ring seals 340 and 341 seal solenoid 326 to stator 328 and to body 312, respectively. With armature 330 closing through-hole 320 as shown in FIG. 1, a small gap 370 exists between stator 328 and armature 330. Axial guidance of the motion of armature 330 that occurs in response to the energization and deenergization of coil 333 is provided by means of a cylindrical pin 331 that is disposed between stator 328 and armature 330 as illustrated.

While a preferred embodiment of the invention has been illustrated and described, it is to be appreciated that principles are applicable to other embodiments.

What is claimed is:

1. An electrically operated fuel injector valve comprising a valve body having a main longitudinal axis, said valve body comprising a cylindrical sidewall that is generally coaxial with said axis and laterally bounds the interior of said valve body and an end wall that is disposed at one longitudinal end of said sidewall generally transverse to said axis, a through-hole disposed in said end wall substantially coaxial with said axis to provide a fuel outlet from the interior of said valve body, said through-hole having a frustoconical valve seat at the axial end thereof which is at the interior of said valve body, said valve body having a fuel inlet at which fuel is supplied to the interior of said valve body, the interior of said valve body comprising means defining a fuel passage from said fuel inlet to said through-hole, said valve body further comprising means defining a raised ledge on the interior thereof which encircles said valve seat in radially outwardly spaced relation thereto, a resilient spring disc whose radially outer peripheral margin is supported on, but otherwise unattached to, said raised ledge and which comprises a central through-aperture comprising a circular void of given diameter, a sphere whose diameter exceeds said given diameter and which is disposed in said through-aperture to fill said circular void, an electrically operated mechanism disposed on said valve body and comprising a longitudinally reciprocal armature means and a bias means that are effective in cooperation with said spring disc to selectively seat and unseat said sphere on and from said seat in accordance with the manner in which said mechanism is electrically operated, said armature means comprising a tip end that in cooperation with said spring disc both axially captures and radially confines said sphere, such capture and confinement being effective to cause said sphere to axially reciprocate with the reciprocal motion of said armature means and thereby selectively seat on and unseat from said seat, and said disc having a size in relation to said valve body that keeps said sphere at least approximately concentric with said axis within the radial confinement imposed on said sphere by said tip end while allowing the disc and sphere together to be radially displaced relative to said axis such that when said mechanism operates to close the fuel injector by displacing said sphere toward said seat, any eccentricity of the sphere relative to said seat is removed by the camming effect of said seat on said sphere with the result that said sphere precisely centers itself on said seat to thereby fully close said through-hole while continuing to fill said void.

2. A fuel injector valve as set forth in claim 1 in which said tip end comprises a frusto-conically walled cavity defining the limits of radial confinement of said sphere.

3. A fuel injector valve as set forth in claim 1 in which said spring disc is circumferentially continuous.

4. A fuel injector valve as set forth in claim 3 in which said through-aperture also comprising at least one additional void is disposed radially outwardly of said circular void.

5. A fuel injector valve as set forth in claim 1 in which said valve body comprises a transverse interior wall spaced interiorly of said end wall, said transverse interior wall comprising guide means for guiding the axial reciprocation of said armature means.

6. A fuel injector valve as set forth in claim 5 in which said fuel inlet comprises a hole through the sidewall of said valve body intercepting the interior of the valve body upstream of said transverse interior wall, said guide means and said armature means cooperatively defining another portion of said fuel passage.

7. A fuel injector valve as set forth in claim 5 in which said valve body comprises two parts that are joined together in assembly, said end wall being in one of said two parts and said transverse interior wall being in the other of said two parts, said one of said parts forming one portion of said sidewall, and said other of said parts forming another portion of said sidewall.

8. A fuel injector valve as set forth in claim 5 including a soft, spongy annular member disposed between said transverse interior wall and the outer peripheral margin of said spring disc.

9. A fuel injector valve as set forth in claim 1 including a soft, spongy annular member disposed on said valve body and contacting the outer peripheral margin of said spring disc.

10. An electrically operated fuel injector valve comprising a valve body having a main longitudinal axis, said valve body comprising a cylindrical sidewall that is generally coaxial with said axis and laterally bounds the interior of said valve body and an end wall that is disposed at one longitudinal end of said sidewall generally transverse to said axis, a through-hole disposed in said end wall substantially coaxial with said axis to provide a fuel outlet from the interior of said valve body, said through-hole having a frustoconical valve seat at the axial end thereof which is at the interior of said valve body, said valve body having a fuel inlet at which fuel is supplied to the interior of said valve body, the interior of said valve body comprising means defining a fuel passage from said fuel inlet to said through-hole, said valve body further comprising means defining a raised ledge on the interior thereof which encircles said valve seat in radially outwardly spaced relation thereto, a resilient spring disc whose radially outer peripheral margin is supported on, but otherwise unattached to, said raised ledge and which comprises a central through-aperture comprising a circular void of given diameter, a sphere whose diameter exceeds said given diameter and which is disposed in said through-aperture to fill said circular void, an electrically operated mechanism disposed on said valve body and comprising a longitudinally reciprocal armature means and a bias means that are effective in cooperation with said spring disc to selectively seat and unseat said sphere on and from said seat in accordance with the manner in which said mechanism is electrically operated, said armature means comprising a tip end that bears against said sphere, said spring disc and said armature means coacting to cause said sphere to axially reciprocate with the reciprocal motion of said armature means and thereby selectively seat on and unseat from said seat, and said disc having a size in relation to said valve body that keeps said sphere at least approximately concentric with said axis while allowing the disc and sphere together to be radially displaced relative to said axis such that when said mechanism operates to close the fuel injector by displacing said sphere toward said seat, any eccentricity of the sphere relative to said seat is removed by the camming effect of said seat on said sphere with the result that said sphere precisely centers itself on said seat to thereby fully close said through-hole while continuing to fill said void, said valve body comprising a transverse interior wall spaced interiorly of said end wall, said transverse interior wall comprising guide means for guiding the axial reciprocation of said armature means.

11. A fuel injector valve as set forth in claim 10 in which said guide means and said armature means cooperatively define one portion of said fuel passage.

12. A fuel injector valve as set forth in claim 11 in which said spring disc is circumferentially continuous.

13. A fuel injector valve as set forth in claim 12 in which said through-aperture also comprising at least one additional void, said at least one additional void is disposed radially outwardly of said circular void.

14. A fuel injector valve as set forth in claim 10 in which said fuel inlet comprises a hole through the sidewall of said valve body intercepting the interior of the valve body upstream of said transverse interior wall.

15. A fuel injector valve as set forth in claim 10 in which said valve body comprises two parts that are joined together in assembly, said end wall being in one of said two parts and said transverse interior wall being in the other of said two parts, said one of said parts forming one portion of said sidewall, and said other of said parts forming another portion of said sidewall.

16. A fuel injector valve as set forth in claim 10 including a soft, spongy annular member disposed between said transverse interior wall and the outer peripheral margin of said spring disc.

17. A fuel injector valve as set forth in claim 10 including a soft, spongy annular member disposed on said valve body and contacting the outer peripheral margin of said spring disc.

18. A fuel injector tip end comprising an end wall containing a central through-hole through which fuel is emitted and which has a frusto-conical valve seat on the interior, a sphere that is disposed substantially concentric with said valve seat and reciprocates to seat on and unseat from said valve seat, and means to maintain said sphere substantially concentric with said valve seat while allowing the sphere to center itself on the valve seat when the sphere moves to close said through-hole, said means comprising a resilient spring disc containing a central circular void of diameter less than the diameter of said sphere, said sphere filling said void, and a raised ledge concentrically surrounding said valve seat in outwardly spaced relation thereto, said disc being circumferentially continuous and supported on, but otherwise unattached to, said ledge in such a manner as to provide for limited radial displacement thereof which prevents said disc from preventing said sphere from ultimately precisely centering itself on said valve seat whenever said sphere is eccentric to said valve seat during the process of seating on said valve seat.

19. A fuel injector tip as set forth in claim 18 in which a soft, spongy annular member is disposed in contact with the peripheral outer margin of said disc.

* * * * *